US005152600A

United States Patent [19]

Boring

[11] Patent Number: 5,152,600

[45] Date of Patent: Oct. 6, 1992

[54] PATTERN LIGHT

[76] Inventor: Mildred L. Boring, 6301 White Oak La., Tamarac, Fla. 33319

[21] Appl. No.: 744,479

[22] Filed: Aug. 12, 1991

[51] Int. Cl.[5] ..... G09F 13/04

[52] U.S. Cl. ..... 362/97; 40/361; 108/23; 356/239

[58] Field of Search ..... 362/97; 40/361; 108/23; 355/67; 356/239

[56] References Cited

U.S. PATENT DOCUMENTS

| | | | |
|---|---|---|---|
| 2,567,561 | 9/1951 | Hoffmann | 362/225 |
| 3,802,102 | 4/1974 | Licciard | 362/97 |
| 3,995,954 | 12/1976 | Dir et al. | 355/67 |
| 4,267,489 | 5/1981 | Morohashi | 40/361 |
| 4,432,043 | 2/1984 | Yuen | 362/217 |
| 4,639,547 | 1/1987 | Jacob-Grinschgl et al. | 178/18 |
| 4,654,762 | 3/1987 | Laverick | 362/97 |
| 4,823,148 | 4/1989 | Sleber et al. | 346/139 |
| 4,888,874 | 12/1989 | Oster | 33/18.1 |
| 4,912,506 | 3/1990 | Sago et al. | 355/113 |

FOREIGN PATENT DOCUMENTS

| | | | |
|---|---|---|---|
| 1222406 | 2/1971 | United Kingdom . | |
| 348829 | 10/1960 | Switzerland | 34/13 |

*Primary Examiner*—Carroll B. Dority

[57] ABSTRACT

A portable illuminated light box is provided for the craft industry such that a pattern may be traced or painted on the fabric of a shirt of other garments. The light box includes a plurality of rechargeable batteries which may be placed upon the side walls of the housing of the light box. The output of the batteries is applied to a low voltage fluorescent light tube having a reflector associated therewith which shines up and through a transparent screen. In one embodiment, the fluorescent light tube and the field associated therewith is transversely moveable along rails mounted within the housing of the light box. A plurality of large C clips may be utilized to temporarily attach the garment in place relative to the light box during tracing or painting of the pattern.

6 Claims, 1 Drawing Sheet

PATTERN LIGHT

BACKGROUND OF THE INVENTION

1. Field of the Invention

This invention relates in general to the field of portable light boxes and in particular to a portable fluorescent light box which may be used in the craft industry to illuminate the underside of a piece of fabric to allow a pattern to be traced or directly drawn on the fabric.

2. Description of the Prior Art

Conventional, non-portable light boxes are well known in the prior art. These light boxes generally consist of a frame of housing having a plurality of light sources therewithin with the housing covered by a sheet of semitransparent glass, such that when the light sources are energized, the screen of the light box presents an illuminated white surface. In general, such prior art light boxes contain a sufficient number of light sources such that the entire screen is brilliantly lighted when turned on. Most often the prior art light boxes are utilized to view developed x-ray film.

Since the prior art light boxes are not portable, an ample number of light bulbs having high wattages may be utilized in conjunction with a 120 volt source. Usually, the heat provided by these ample light sources is no problem in that the light box may be adequately ventilated to release the heat generated therewithin. Portable light boxes, on the other hand, must rely upon the low voltage supplied by batteries and such that the overall weight of the portable light box is sufficiently low. A portable light box cannot use a plurality of hot light sources because of the extreme current drain from the batteries in order to give the portable light box sufficient life time and the inability to adequately vent the housing to eliminate the heat generated therewithin. Accordingly, a portable light box would preferably use a low voltage, small in size, fluorescent light bulb which does not generate much heat and does not consume an undue amount of electricity.

Accordingly, a primary object of the present invention is to provide a portable light box utilizing a fluorescent light bulb which is small in size and sufficiently lightweight so as to make the device more easily portable.

Another object of the present invention is to provide a portable light box utilizing a fluorescent light bulb and powered by batteries which are sufficiently bright to enable the light to penetrate to a relatively dark material.

Another object of the present invention is to provide a portable light box utilizing a fluorescent tube powered by batteries which allows illumination across the entire width and breadth of the screen of the light box.

Another object of the present invention is to provide a portable light box having a screen which is only slightly smaller than the housing within which the screen is placed.

The above-stated objects as well as other objects which, although not specifically stated, but are intended to be included within the scope of the present invention, are accomplished by the present invention and will become apparent from the hereinafter set forth Detailed Description of the Invention, Drawings, and the claims appended herewith.

SUMMARY OF THE INVENTION

The present invention accomplishes the above-stated objectives as well as others, as may be determined by a fair reading and interpretation of the entire specification herein, which comprises a portable light box powered by a fluorescent light bulb which is supplied electrical energy by preferably rechargeable batteries. The screen associated with the light box is completely transparent in order to allow maximum light to pass through the screen. Moreover, the screen is essentially the same size as or slightly smaller than the overall dimensions of the light box housing. A reflector is utilized with the fluorescent tube to enhance the size of the beam of light passing through the transparent screen. In one embodiment, the fluorescent tube and the reflector are movable within the housing so as to position the fluorescent tube at a particularly desired location on the screen.

A relatively thin housing having a substantially rectangular shape is preferably made from aluminum to be lightweight and readily dissipate heat. A fluorescent light tube having a length which is slightly smaller than one of the width dimensions of the rectangular housing is mounted on a base member which is slidingly attached to a pair of tracks extending transverse to the longitudinal axis of the fluorescent tube and within the light box housing. A flexible device, such as string or a rigid push-pull rod, is attached to either side of the base member and extends in the same direction as the tracks through an opening in the housing to the outside thereof. By simply pushing or pulling on one of the rigid push-pull rods, the fluorescent light tube may be moved along the tracks to move the light tube to one side or the other of the light box. Or, by simply grasping a pair of oppositely mounted strings, the fluorescent light tube may be moved along the tracks to one side or the other of the light box housing. The reflective shield is also mounted to the base member such that the shield moves with the fluorescent light tube. The rechargeable batteries may be appropriately mounted to the sides of the housing which extend parallel to the longitudinal axis of the fluorescent light tube. A ballast which is used to preheat the electrodes and initiating an arc discharge may be placed at any convenience location within the housing of the light box.

BRIEF DESCRIPTION OF THE DRAWINGS

Various other objects, advantages, and features of the invention will become apparent to those skilled in the art from the following discussion taken in conjunction with the following drawings, in which.

DESCRIPTION OF THE PREFERRED EMBODIMENTS

Figure 1:
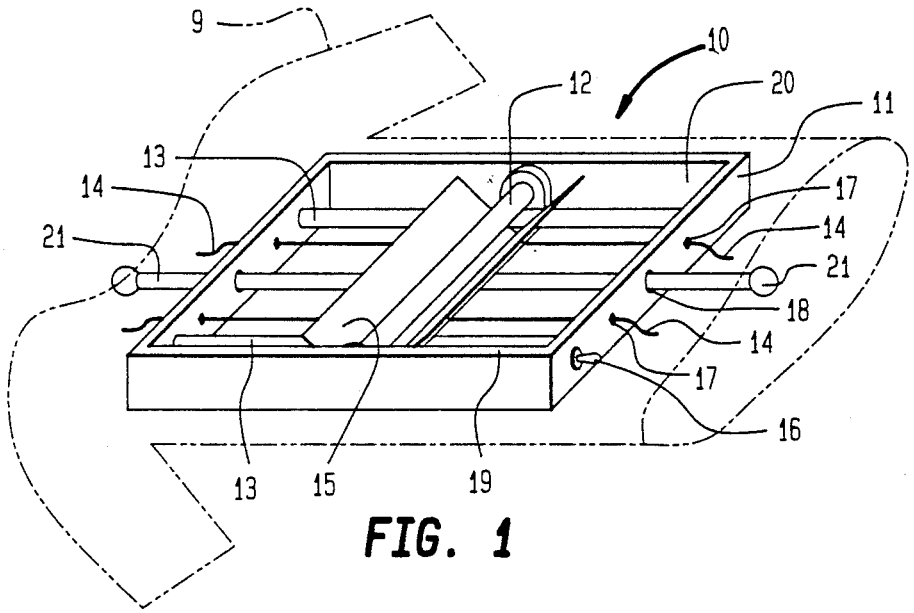
FIG. 1 is an isometric view of the inventive light box shown in use with a shirt on which is to be painted or traced a particular pattern.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various figures are designated by the same reference numerals.

Reference is now made to FIG. 1 of the drawings wherein the inventive light box is, in general, designated by the numeral 10. Light box 10 comprises a housing which may be made from sheet metal, such as aluminum or plastic, having the approximate size of 12×12 inches. The height of the housing 11 may be of the order of three-to-five inches. An angled frame 19, is positioned along the top, folded-inward edge of the housing 11 such that it covers a part of the side wall of the enclosure 11 as well as part of the screen 20. Each angled side of frame 19 may be approximately one-half-to-one inch wide, which would leave a screen of approximately 10×10 inches square. Screen 20 may be made from transparent glass or plastic. Frame 19 may be held in place with respect to housing 11 by screws appropriately positioned around the perimeter of frame 19. Removal of such screws would allow removal of the frame 19 and thereafter removal of the transparent screen 20 such that the inside components of the inventive light box 10 are accessible. Or, in the alternative, a slot may be provided across the width of one side edge of frame 19 such that the transparent screen 20 may be slid through the slot and out of the light box 10 to expose and replace the bulb 12 or the batteries 31 therein.

A pair of spaced parallel rails 13 are each attached to opposite sides of housing 11 and positioned transverse to the longitudinal axis of fluorescent light tube 12. A reflective shield 15, which may be made from highly polished aluminum or chrome-plated plastic, has an approximate V-shaped configuration with the apex being placed under fluorescent light tube 12. The purpose of shield 18 being, of course, to multiply or enhance the effect of the fluorescent tube 12 when lighted. A pair of strings 14 are attached to opposite sides of the florescent light tube assembly and emanate or extend through openings 17 in the sides of housing 11. By means of pulling on one opposite pair of strings 14, the fluorescent light tube assembly may be moved to one side or the other or any position therebetween of the housing 11. As an alternative to strings 14, a push-pull rod 21 may be used. A push-pull rod 21 may be attached to each side of base member 23 and extend therefrom through and out of opening 18 in the sides of housing 11. A switch 16 activates the electrical circuit which provides electrical energy to fluorescent tube 12 in order to light the same.

Figure 6:
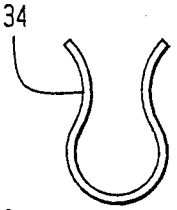

In use, a shirt 9 or other fabric on which is to be traced or painted a particular pattern is placed over the inventive light box. Prior to placing the shirt 9 or other fabric thereon, the pattern desired to be traced or painted is first placed on light screen 20 and appropriately temporarily fastened thereto, such as by transparent tape. When the light box 10 is turned on by means of switch 16, the fluorescent light bulb 12 lights up and shines up through the pattern and through the fabric of the shirt 9. The reflective shield 15 multiplies the effect of the lighted fluorescent light tube 12 and provides a broader area across the screen which is effectively illuminated. Should the amount of light shining through the fabric of shirt 9 be insufficient due, for example, to the darkness or thickness of the fabric of shirt 21, the fluorescent light tube assembly may be moved to either side in order to trace the pattern at that particular location. A plurality of clips 34 as shown in FIG. 6 may be utilized in conjunction with the shirt or fabric 9 in order to clip the shirt 9 in position on the light box. Clip 34 is sufficiently large and flexible so as to fit around the top and one side and bottom of the frame or housing 11. The plurality of clips 34 allow the person using the inventive light box 10 to temporarily fix the shirt or fabric 21 in position with respect to the pattern placed on the light box 10.

Figure 2:
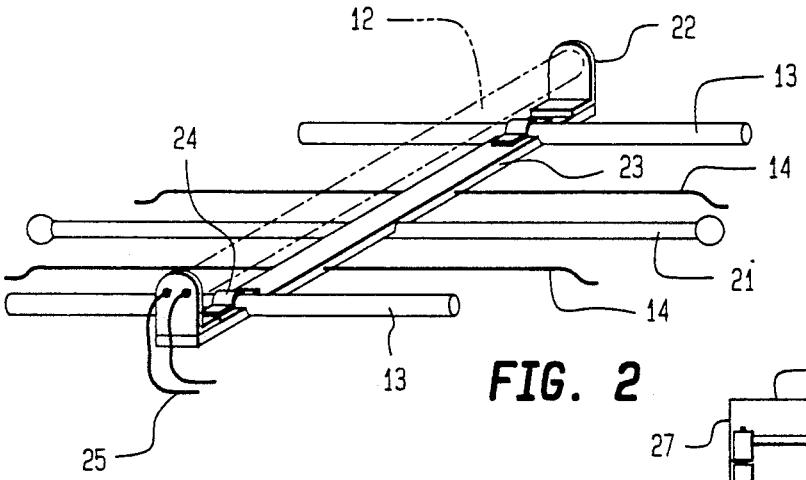
FIG. 2 is a isometric view of the fluorescent tube portion of the light box of FIG. 1 excluding the frame and light shield for purposes of clarity.

FIG. 2 illustrates some of the details of the fluorescent light tube assembly. The fluorescent light tube 12 is held in place by an opposite pair of lamp holders 22 which have an approximately L shape and which are adapted to electrically receive the ends of fluorescent tube 12. The base portion of lamp holders 22 are fixedly secured to a base member 23 extending between the opposite pair of lamp holders 22. A pair of semicircular clips 24 ar provided along the length base member 23 for the positioning therethrough of tracks 13. This arrangement allows the fluorescent light tube 12, the pair of lamp holders 22, and the base member 23 to be moved transversely to either side of the longitudinal axis of tracks 13. In order to facilitate such movement, a pair of strings 14 may be fixedly secured to opposite side edges of base member 23 extending substantially along the length of track 13 and through and out of the side walls of housing 11. As mentioned above, by simply pulling or pushing the push-pull rods 2; on each side of the housing in a direction away from or toward the housing, causes the fluorescent light tube 12 to move along track 13 in the direction of pulling or pushing of the rods 21. Thus, a simple and effective method and apparatus are disclosed to move the fluorescent light tube 12 to a position other than within the approximate center of the square shape of housing 11 if the light provided along the sides of fluorescent tube 12 is insufficient to be able to see the pattern through the fabric.

A sufficient length of electrical wiring 25 should be attached to one of the lamp holders 22 and to the output of batteries 31 (see FIG. 5) in order to allow sufficient movement of fluorescent light tube 12 without any strain on electrical wires 25.

Figure 3:
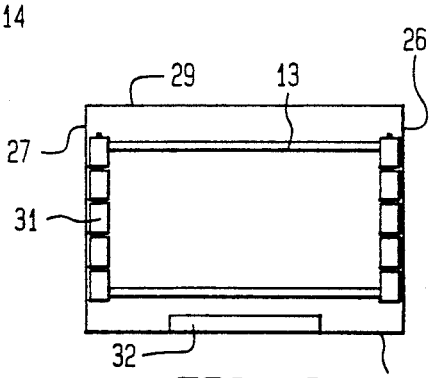
FIG. 3 is a top plan view of the housing of the inventive light box illustrating the location of a plurality of batteries on opposite sides of the housing. For purposes of clarity, the florescent light tube and its supporting structure is not shown.
Figure 4:
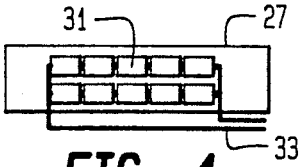
FIG. 4 is a side plan view of one wall of the housing of the inventive light box showing the location of batteries thereon.

FIGS. 3 and 4 show one method whereby a plurality of batteries, such as conventional D size rechargeable batteries, may be placed in order to minimize the bulkiness of the same within the housing. As can be seen, batteries 31 may be arranged in series and then parallel with each other in order to achieve approximately twelve volts which may also be the rating of fluorescent light tube 12. The location of batteries 31 along the length of sides 26 and 27 of housing 11 allows the fluorescent light tube 12 and the shield 15 to be moved to either of said sides without interference by the batteries 31 and whereby the batteries 31 fit under one of the extending wings of light shield 15. It is to be noted that the battery placement of batteries 31 as shown in FIGS. 3 and 4 are schematic and are intended to be such that the batteries may be removably attached within appropriate battery receptacles (not shown) and held in place therein by the spring tension provided by such receptacles as is well known in the art. A ballast member 32 which typically is relatively long but slender may be placed on the bottom surface of housing 11 or one of the unused sides thereof 28 or 29.

Figure 5:
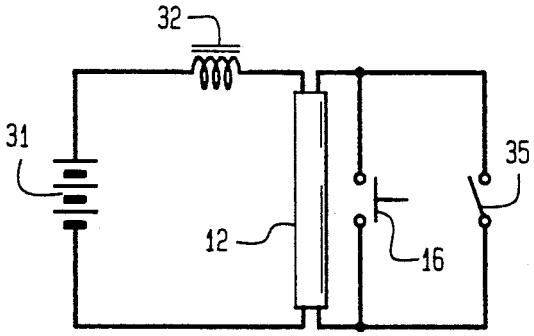
FIG. 5 is a schematic electrical drawing of the circuit used to power the fluorescent tube; and, FIG. 6 is a typical clip which may be used to secure the fabric or garment to the inventive light box while the tracing or painting is being accomplished.

FIG. 5 shows a typical electrical schematic drawing of the circuit of the fluorescent light tube 12 including switch 16 and automatic starter or switch 35. Such typical circuit is well known in the art.

While the invention has been described, disclosed, illustrated and shown in certain terms or certain embodiments or modifications which it has assumed in practice, the scope of the invention is not intended to be nor should it be deemed to be limited thereby and such other modifications or embodiments as may be suggested by the teachings herein are particularly reserved especially as they fall within the breadth and scope of the claims here appended.

I claim as my invention:

1. A portable fluorescent light box for use in the craft industry, comprising:

a housing;

a transparent cover on said light box;

a longituidinal fluorescent light source within said housing;

means in said housing for mounting said light source for movement in either direction across the width of said housing transverse to a longitudinal axis of said fluorescent light source;

means external to said housing and connected to said means for mounting said light source for moving said fluorescent light source;

a plurality of batteries for supplying DC power to said light source; and a switch to activate and deactivate said light source.

2. The portable light box of claim 1, including a reflective light shield positioned parallel to said light tube to enhance the effect of the light emanating from said light box.

3. The portable light box of claim 1, wherein said batteries are mounted to a side wall inside said housing.

4. The portable light box of claim 1, wherein said means for moving the light source comprises a rod mounted on each side of said light source, said rod extending through and out of an opening in a side wall of said housing.

5. The light box of claim 1, wherein said light source is mounted on a base member, said means for mounting said light source for movement includes said base member being movably mounted on a pair of tracks extending across a width of said housing.

6. The portable light box of claim 2 wherein said reflective shield is movable together with said light source.

* * * * *